US007644674B1

(12) United States Patent
Goldston

(10) Patent No.: US 7,644,674 B1
(45) Date of Patent: Jan. 12, 2010

(54) MARINE VESSEL STABILIZATION SYSTEM

(76) Inventor: John Goldston, 1508 Warrick Ave., Dothan, AL (US) 36303

( * ) Notice: Subject to any disclaimer, the term of this patent is extended or adjusted under 35 U.S.C. 154(b) by 0 days.

(21) Appl. No.: 12/332,761

(22) Filed: Dec. 11, 2008

Related U.S. Application Data

(60) Provisional application No. 61/013,044, filed on Dec. 12, 2007.

(51) Int. Cl.
*B63B 39/00* (2006.01)
*B63B 43/14* (2006.01)
*B63B 17/00* (2006.01)

(52) U.S. Cl. ..... 114/123; 114/343; 114/364

(58) Field of Classification Search ... 114/61.15–61.19, 114/68, 121, 123, 283, 292, 343, 360, 364
See application file for complete search history.

(56) References Cited

U.S. PATENT DOCUMENTS

| | | | | |
|---|---|---|---|---|
| 655,234 | A | | 8/1900 | Howe et al. |
| 1,054,851 | A | | 3/1913 | Leblond |
| 1,371,139 | A | | 3/1921 | Banaszak |
| 3,276,413 | A | * | 10/1966 | Dolph et al. ..... 114/123 |
| 3,792,676 | A | | 2/1974 | Craft |
| 3,952,680 | A | | 4/1976 | Griffin |
| 5,988,090 | A | | 11/1999 | Barker, Jr. |
| 6,305,306 | B1 | | 10/2001 | Grzybowski |
| 2002/0083881 | A1 | | 7/2002 | Arias |

FOREIGN PATENT DOCUMENTS

| | | |
|---|---|---|
| JP | 62244790 A | 10/1987 |

* cited by examiner

*Primary Examiner*—Ajay Vasudeva
(74) *Attorney, Agent, or Firm*—Garvey, Smith, Nehrbass & North L.L.C.; Seth M. Nehrbass; Charles C. Garvey, Jr.

(57) ABSTRACT

An outrigger and hull provides outriggers mounted with hinges to plates that enable pivotal or rotatable movement of each outrigger between storage and operating positions. Locking members secure the outriggers from substantial movement when in the operating position.

4 Claims, 4 Drawing Sheets

MARINE VESSEL STABILIZATION SYSTEM

CROSS-REFERENCE TO RELATED APPLICATIONS

Priority of my U.S. provisional patent application No. 61/013,044, filed 12 Dec. 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved outrigger system for a boat. More particularly, the present invention relates to an improved boat outrigger arrangement that enables a pair of outrigger pontoons to be moved from an operating position wherein they engage a surrounding water surface to a disengaged position wherein they fold inwardly and wherein locking pins secure the outriggers in the outer position by removably connecting a hinge plate portion of an outrigger to a gunwale mount.

2. General Background of the Invention

Outriggers have been used to help stabilize a marine vessel during use. Examples of such outriggers are seen in the following possibly relevant patents.

The following U.S. Patents are incorporated herein by reference:

TABLE

| U.S. Pat. No. | TITLE | ISSUE DATE |
|---|---|---|
| 6,55,234 | Boat Attachment | Aug. 07, 1900 |
| 1,054,851 | Life Boat | Mar. 04, 1913 |
| 1,371,139 | Boat Stabilizing Device | Mar. 08, 1921 |
| 3,792,676 | Ballast Attachment for Boats | Feb. 19, 1974 |
| 3,952,680 | Roll Stabilizer for Vessels at Rest | Apr. 27, 1976 |
| 5,988,090 | Stabilization Pontoon System for Small Watercraft | Nov. 23, 1999 |
| 6,305,306 | Watercraft Stabilizer System | Oct. 23, 2001 |
| 2002/0083881 | Adjustable Platform Structures for Boats | Jul. 04, 2002 |
| JP62244790 | Ship Roll Reducing Device | Oct. 26, 1987 |

Outriggers that are fixed suffer in that the extra width or beam restricts access into narrowed areas when underway.

BRIEF SUMMARY OF THE INVENTION

The present invention provides an improved outrigger arrangement that enables a user to operate his or her boat when underway or on plane with the outriggers folded to an inner position. In the folded, inner position the outriggers do not engage the surrounding water. In the extended outer position the outriggers and their pontoons outboard of the boat are placed in the surrounding water for increased stability.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
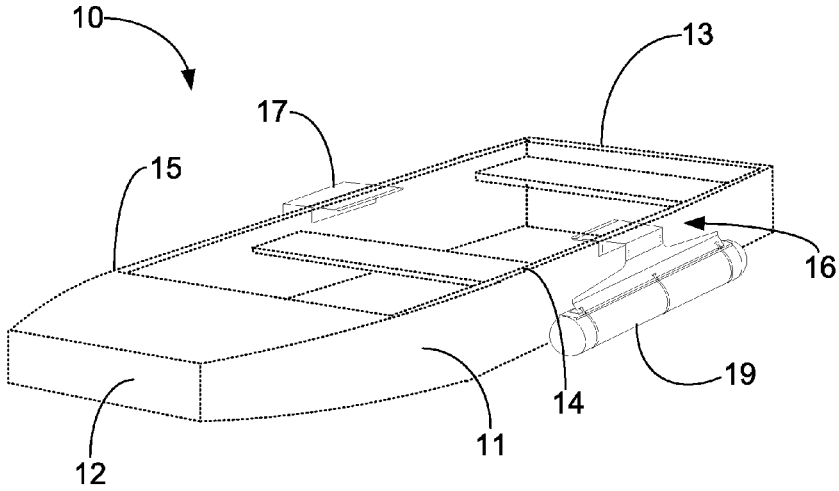
FIG. 1 is a perspective view of the preferred embodiment of the apparatus of the present invention.
Figure 2:
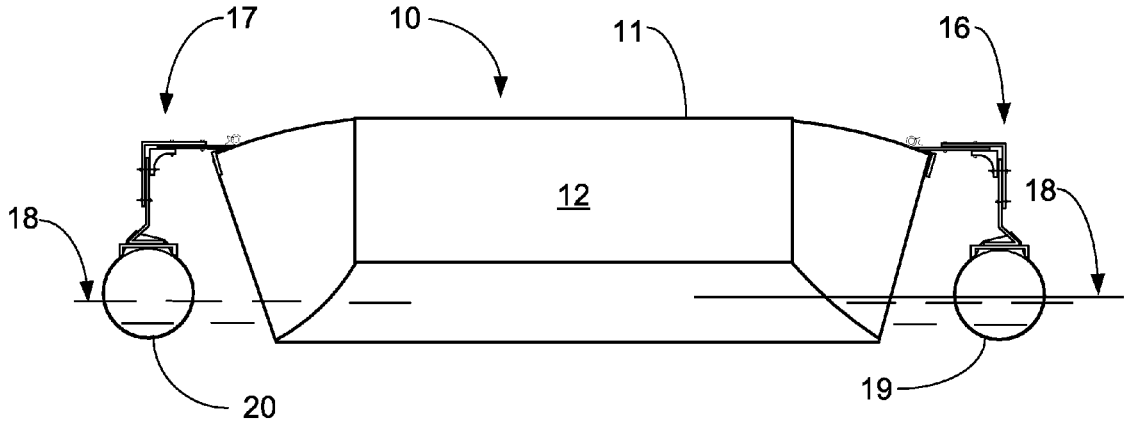
FIG. 2 is a front elevation view of the preferred embodiment of the apparatus of the present invention.

FIGS. 1-7 show the preferred embodiment of the apparatus of the present invention, designated generally by the numeral 10 in FIGS. 1-2. Vessel 10 provides a hull 11 that has a bow 12 and stern 13.

The hull 11 also provides a pair of spaced apart gunwales 14, 15.

A pair of outriggers 16, 17 are provided, each outrigger supporting a pontoon 19, 20. Port outrigger 16 provides a port pontoon 19. Starboard outrigger 17 provides starboard pontoon 20. The outriggers 16, 17 and associated pontoons 19, 20 are moved between an operating position shown in FIG. 2 and a folded or storage position shown in FIG. 5. In the operating position, each of the pontoons 19, 20 engages the water surface area 18 to provide stability for the craft.

The pontoons 19, 20 and outriggers 16, 17 can be moved to the position of FIG. 2 for example, when the boat is underway or at anchor. For example, when the pilot of the boat is fishing, stability is of utmost importance. The outriggers 16, 17 and pontoons 19, 20 can be used for other activity wherein stability is important, such as for example, when using the hull 11 as a hunting platform.

Figure 7:
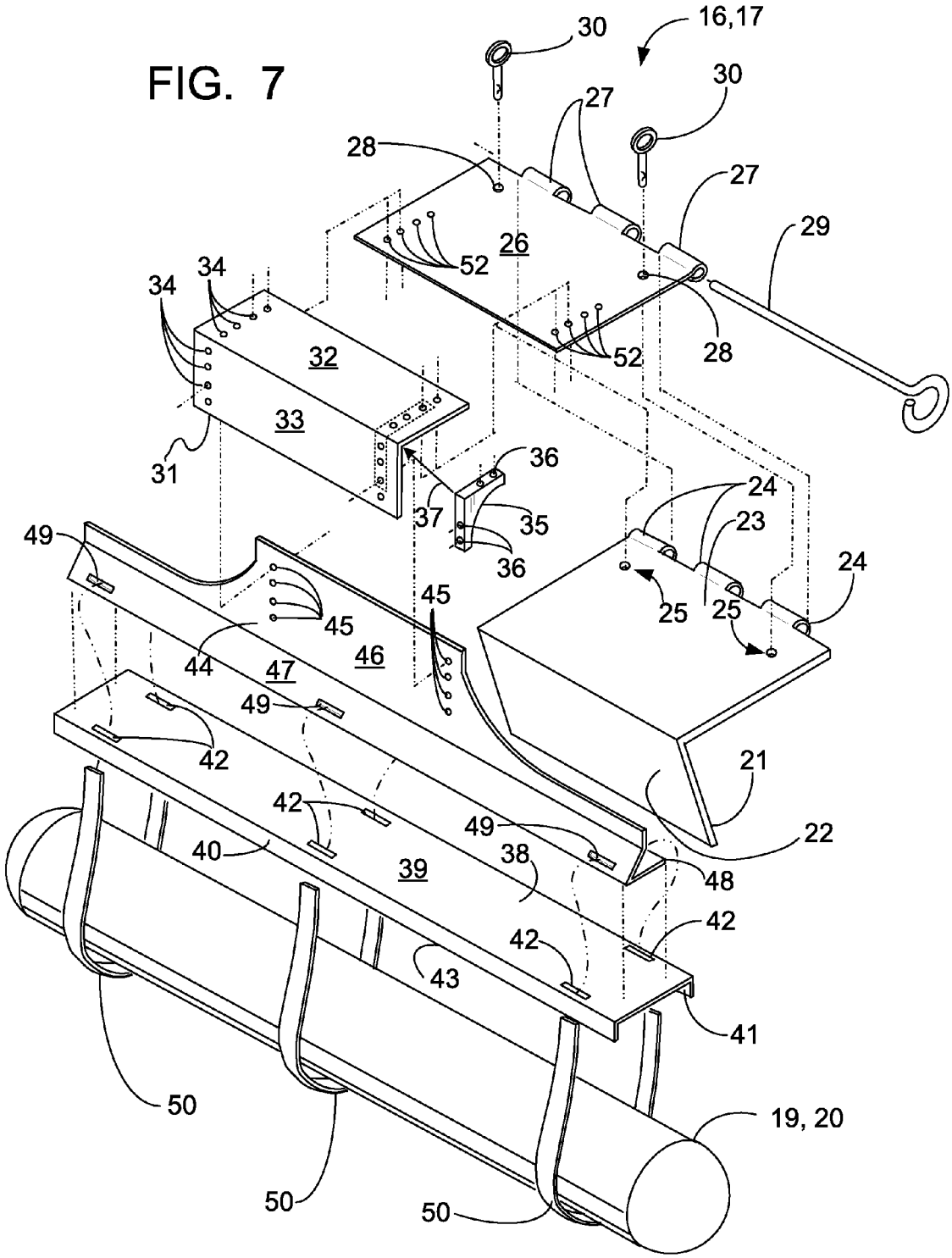
FIG. 7 is a partial exploded perspective view of the preferred embodiment of the apparatus of the present invention.

In FIGS. 3-7, outriggers 16, 17 and pontoons 19, 20 are shown in more detail. FIG. 7 provides an exploded view. The outrigger and pontoon arrangement shown in FIG. 7 is the same for either outrigger 16 and its pontoon 19 or outrigger 17 and its pontoon 20.

The parts of FIG. 7 will be described in more detail with reference to a single outrigger 16 or 17 and a single pontoon 19 or 20. Outrigger 16, 17 provides a gunwale mount 21 that can be in the form of a pair of plates 22, 23 that are attached to form an obtuse angle as shown in FIG. 7. Gunwale mount 21 can be bolted to the gunwale 14 or 15 of hull 11. A backing plate 51 can be used if the hull 11 is relatively thin walled at gunwale 14 or 15 such as for example in the case of an aluminum skiff or boat (see FIGS. 4 and 5).

Fasteners such as bolted connections can be used to attach gunwale mount 21 and backing plate 51 to hull 11 at a position next to gunwale 14 or 15. In FIG. 7, plate 23 provides a plurality of hinge eyes 24. Plate 23 is also provided with one or more openings 25 that are receptive of locking pins 30. Hinge plate 26 can be removably attached to gunwale mount 21 using hinge pin 29.

Hinge plate 26 provides a plurality of hinge eyes 27 and openings 28. Locking pins 30 rigidify an assembly of gunwale mount 21 and hinge plate 26 by placing each locking pin 30 through the aligned openings 28, 25 of the hinge plate 26 and gunwale mount 21. This operating position arrangement can be seen in FIG. 3.

Figure 3:
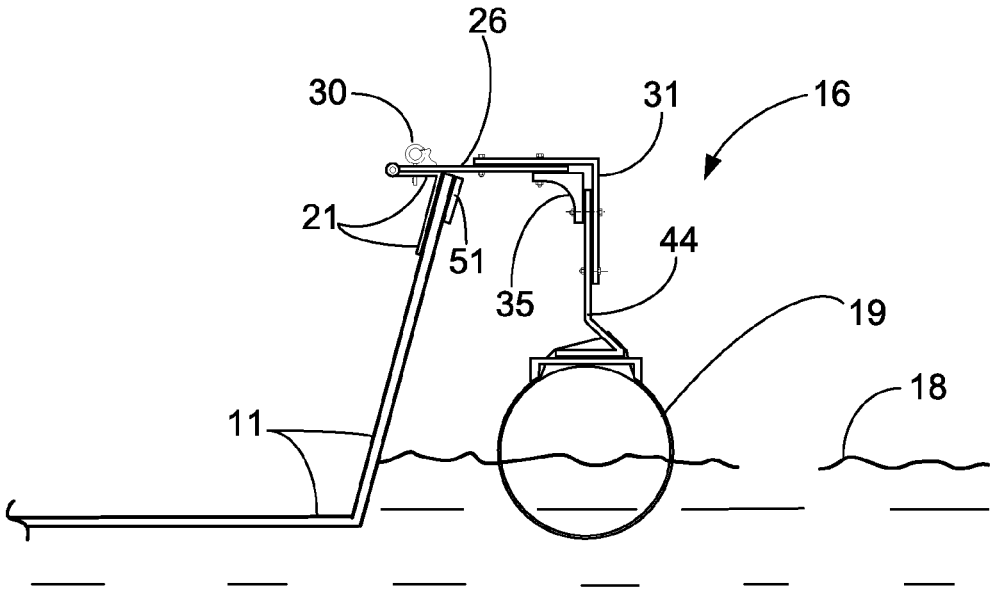
FIG. 3 is a fragmentary sectional view of the preferred embodiment of the apparatus of the present invention showing the pontoon and outrigger in an outer position.
Figure 4:
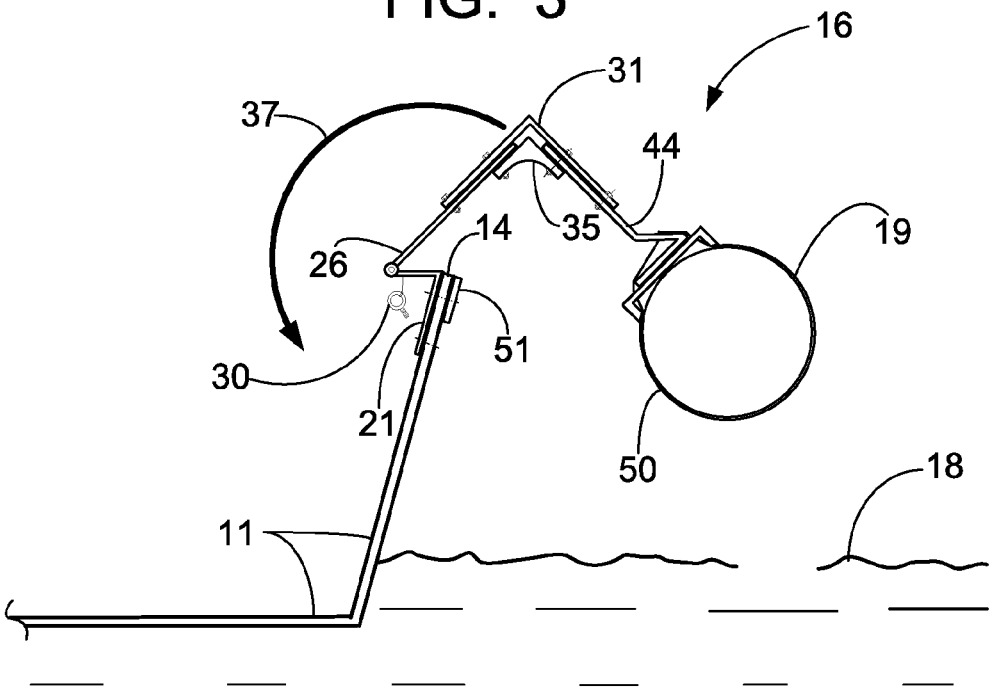
FIG. 4 is a fragmentary sectional view of the preferred embodiment of the apparatus of the present invention showing the outrigger as it is being moved from an outer, operating position to an inner, folded storage position.
Figure 5:
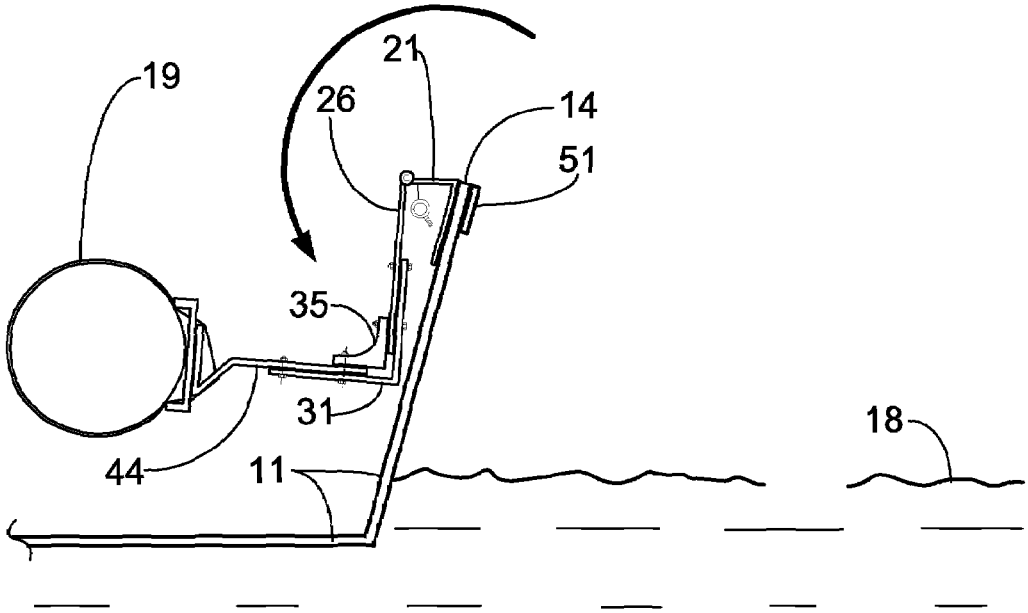
FIG. 5 is a fragmentary sectional view of the preferred embodiment of the apparatus of the present invention showing the outrigger and its pontoon in an inner, folded storage position.
Figure 6:
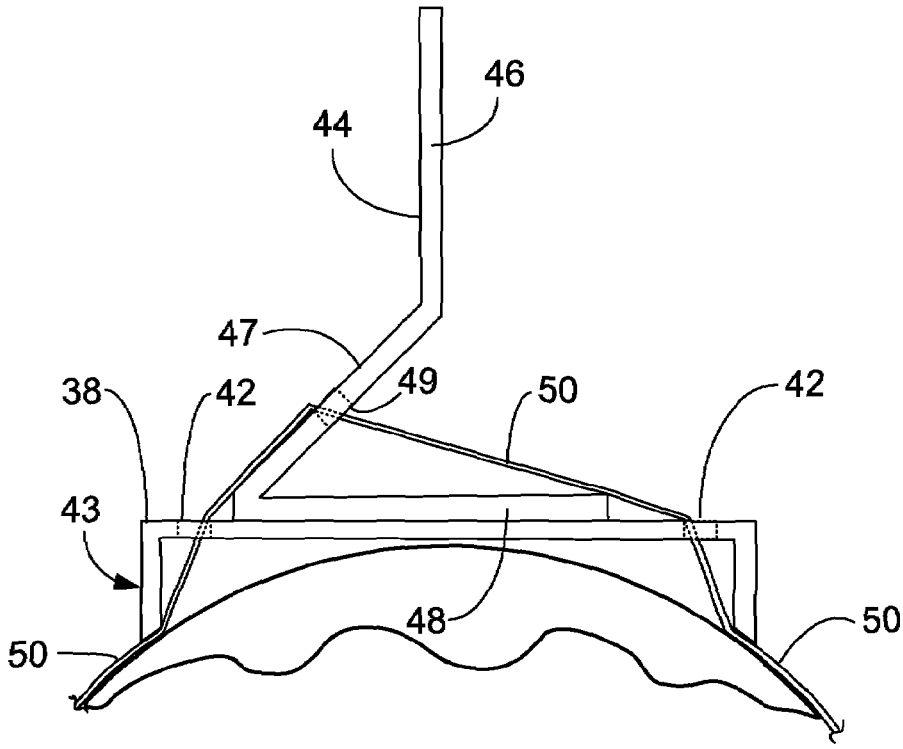
FIG. 6 is a partial sectional view of the preferred embodiment of the apparatus of the present invention.

Angle section 31 is comprised of plates 32, 33 that are attached generally perpendicularly. Each of the plates 32, 33 provides a plurality of openings 34. A pair of angle braces 35 can be attached to angle section 31 by aligning the openings 36 of the angle brace 35 with the openings 34 of the angle section 31 and securing them together using fasteners such as bolted connections. The openings 34 of angle section 31 are also aligned with the openings 52 of hinge plate 26 so that at least some of the bolted connections that secure angle brace 35 to angle section 31 also secures the assembly of angle section 31 and angle brace 35 to hinge plate 26 as shown in FIGS. 3-5. When locking pins 30 are removed, pontoons 19, 20 can be rotated from the operating position of FIG. 3 to the storage position of FIG. 5 as indicated by arrow 37 in FIG. 4. As seen in FIG. 3, when the outrigger is in the operating position, hinge plate 26 overlaps plate 23. As further seen in FIG. 5, when the outrigger is in the storage position, hinge plate 26 is spaced away from plate 23.

Each pontoon 19, 20 is assembled to a outrigger 16, 17 by providing a pontoon channel 38 that attaches to a pontoon support 44 which is bolted to an assembly of angle section 31 and a pair of angle braces 35 (see FIGS. 3-5). In FIG. 7, pontoon channel 38 includes web 39 and a pair of spaced apart flanges 40, 41. Slots 42 on channel 38 are receptive of straps 50 which secure each pontoon 19 or 20 to its outrigger 16 or 17. Openings 45 in plate 46 of pontoon support 44 enable a bolted connection to be formed between the assembly of angle section 31 and angle braces 35 to pontoon support 44. The pontoon support 44 includes plate 46 and flanges 47, 48. Slots 49 in flange 47 are also receptive of straps 50 (see FIG. 6).

The pin 29 is removable for enabling the entire assembly of an outrigger 16 or 17 and its pontoon 19 or 20 to be removed from vessel 10. By removing the pin 29, each outrigger 16 or 17 can be separated from its gunwale mount 21.

The following is a list of parts and materials suitable for use in the present invention.

PARTS LIST

Part Number Description
10 vessel
11 hull
12 bow
13 stern
14 gunwale
15 gunwale
16 port outrigger
17 starboard outrigger
18 water surface area
19 port pontoon
20 starboard pontoon
21 gunwale mount
22 plate
23 plate
24 hinge eye
25 opening
26 hinge plate
27 hinge eye
28 opening
29 hinge pin
30 locking pin
31 angle section
32 plate
33 plate
34 opening
35 angle brace
36 opening
37 arrow
38 pontoon channel
39 web
40 flange
41 flange
42 slot
44 pontoon support
45 opening
46 plate
47 flange
48 flange
49 slot
50 strap
51 backing plate
52 openings The foregoing embodiments are presented by way of example only; the scope of the present invention is to be limited only by the following claims.

The invention claimed is:

1. An outrigger apparatus and a boat hull that has port and starboard gunwales, comprising:

a) a pair of mounting plates, each removably attachable to the boat hull next to one of said port and starboard gunwales;

b) a pair of outriggers, each pivotally mounted to one of said pair of mounting plates with an outrigger plate having a hinge, wherein each hinge is generally horizontally oriented and generally parallel to a central longitudinal axis of the hull;

c) a plurality of openings on each mounting plate spaced from the hinge;

d) a plurality of openings on each outrigger plate spaced from the hinge;

e) each outrigger being pivotally movable between operating and storage positions, wherein in the operating position each outrigger plate overlaps each mounting plate and the openings on each mounting plate align with the openings on each outrigger plate, and wherein in the storage position each outrigger plate is spaced away from each mounting plate;

f) locking pins that are placeable through the aligned openings of the mounting plate and the outrigger plate, enabling the locking pins to prevent rotation of the outrigger plate relative to the mounting plate; and g) wherein each outrigger includes a pontoon connected to a said outrigger plate.

2. The outrigger apparatus of claim 1 wherein each pontoon is connected to the outrigger plate with one or more members positioned in between the pontoon and outrigger plate.

3. The outrigger apparatus of claim 2 wherein each pontoon is connected to the outrigger plate with one or more generally vertically extending members positioned in between the pontoon and outrigger plate.

4. The outrigger apparatus of claim 3 wherein a strap connects each pontoon to the vertically extending member.

* * * * *